US011026015B2

(12) United States Patent
Zhang

(10) Patent No.: US 11,026,015 B2
(45) Date of Patent: Jun. 1, 2021

(54) SPEAKER

(71) Applicant: AAC Technologies Pte. Ltd., Singapore (SG)

(72) Inventor: Tong Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/699,154

(22) Filed: Nov. 29, 2019

(65) Prior Publication Data

US 2020/0196049 A1 Jun. 18, 2020

(30) Foreign Application Priority Data

Dec. 17, 2018 (CN) ..... 201822113918.3

(51) Int. Cl.
*H04R 1/28* (2006.01)
*H04R 9/06* (2006.01)

(52) U.S. Cl.
CPC ..... *H04R 1/2811* (2013.01); *H04R 9/06* (2013.01)

(58) Field of Classification Search
None
See application file for complete search history.

(56) References Cited

U.S. PATENT DOCUMENTS 4,709,392 A * 11/1987 Kato ..... H04R 7/26 181/157
2014/0119578 A1* 5/2014 Choi ..... H04R 1/00 381/162
2015/0016657 A1* 1/2015 Song ..... H04R 7/10 381/398
2016/0014519 A1* 1/2016 Oclee-Brown ..... H04R 7/02 381/398
2016/0227324 A1* 8/2016 Cai ..... H04R 7/14
2017/0347197 A1* 11/2017 Mao ..... H04R 9/025
2017/0347200 A1* 11/2017 Mao ..... H04R 9/06
2018/0027334 A1* 1/2018 Mao ..... H04R 7/18 381/398
2018/0027336 A1* 1/2018 Li ..... H04R 9/06 381/398
2019/0028804 A1* 1/2019 Zhao ..... H04R 9/02

* cited by examiner

*Primary Examiner* — Paul W Huber
(74) *Attorney, Agent, or Firm* — W&G Law Group LLP

(57) ABSTRACT

The present invention provides a speaker, which includes a basket, a diaphragm fixed to the basket, and a voice coil located below the diaphragm and used for driving the diaphragm to vibrate and sound. The diaphragm includes a dome and a folded ring. The dome includes two first straight edges arranged oppositely and two second straight edges connected with the two first straight edges, the dome includes a central portion and an edge portion, the edge portion includes a first region arranged along the first straight edge and a second region arranged along the second straight edge, and both the first region and the second region are provided with an opening portion penetrating through the dome along a vibration direction.

5 Claims, 2 Drawing Sheets

SPEAKER

TECHNICAL FIELD

The present disclosure relates to electroacoustic technologies, and more particularly, to a speaker.

BACKGROUND

An electroacoustic device is a member in an electronic field. With a development of an electronic industry, an electroacoustic system needs to continuously meet higher requirements of consumers for product performance and to present essence of sound more perfectly.

As a core sound member of a speaker, quality for designing a diaphragm directly affects acoustic performance of the speaker. The diaphragm usually includes a dome in a center and a folded ring surrounding the dome. The vibration of the diaphragm is mainly focused on the vibration of the dome. The dome has a larger amplitude and a higher frequency than that of the folded ring, and is an important part for reflecting acoustic effect of a sound device.

The dome in existing technologies is a plate structure, and is a rectangle with rounded corners. In order to reduce mass of the dome, holes are usually cut at a straight edge of the dome. Because the dome is prone to split vibration due to insufficient strength when vibrating at a high frequency, cutting holes at the straight edge of the dome is bound to severely reduce strength of the dome and affect high-frequency characteristic of the product. In addition, cutting holes at an edge of the dome will increase a blank area from an inner edge of the folded ring of the diaphragm to an inner edge of the dome, which will easily wrinkle the product and reduce reliability of the product when the product is vibrating and falling.

Therefore, it is necessary to provide a new speaker with an improved dome structure.

DETAILED DESCRIPTION

Figure 1:
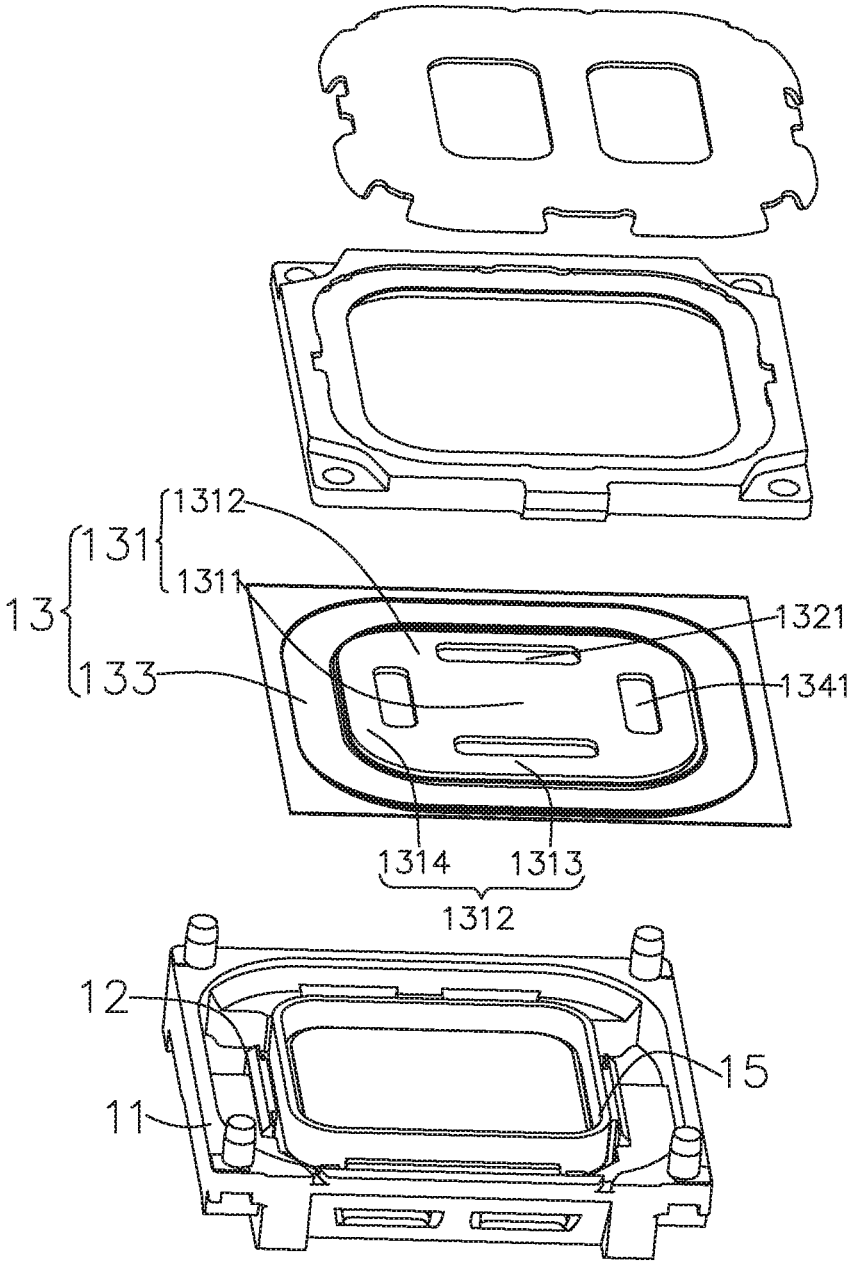
FIG. 1 is an exploded perspective view of a speaker according to the present disclosure.

In order to better understand solutions of the present disclosure and advantages thereof in various aspects, the present disclosure will be described in further detail below with reference to drawings through specific embodiments. In the following embodiments, a left-right direction in a principal plane of the drawing is taken as a horizontal direction, and an up-down direction in the principal plane of the drawing is taken as a vertical direction. In addition, the following specific embodiments are provided to facilitate a clearer and more thorough understanding of contents of the present disclosure, rather than to limit the present disclosure.

In order to effectively reduce mass of the dome while ensuring that high-frequency characteristic of the product is not affected, the present disclosure improves a structure of the dome, and the specific solution is as follows.

Figure 2:
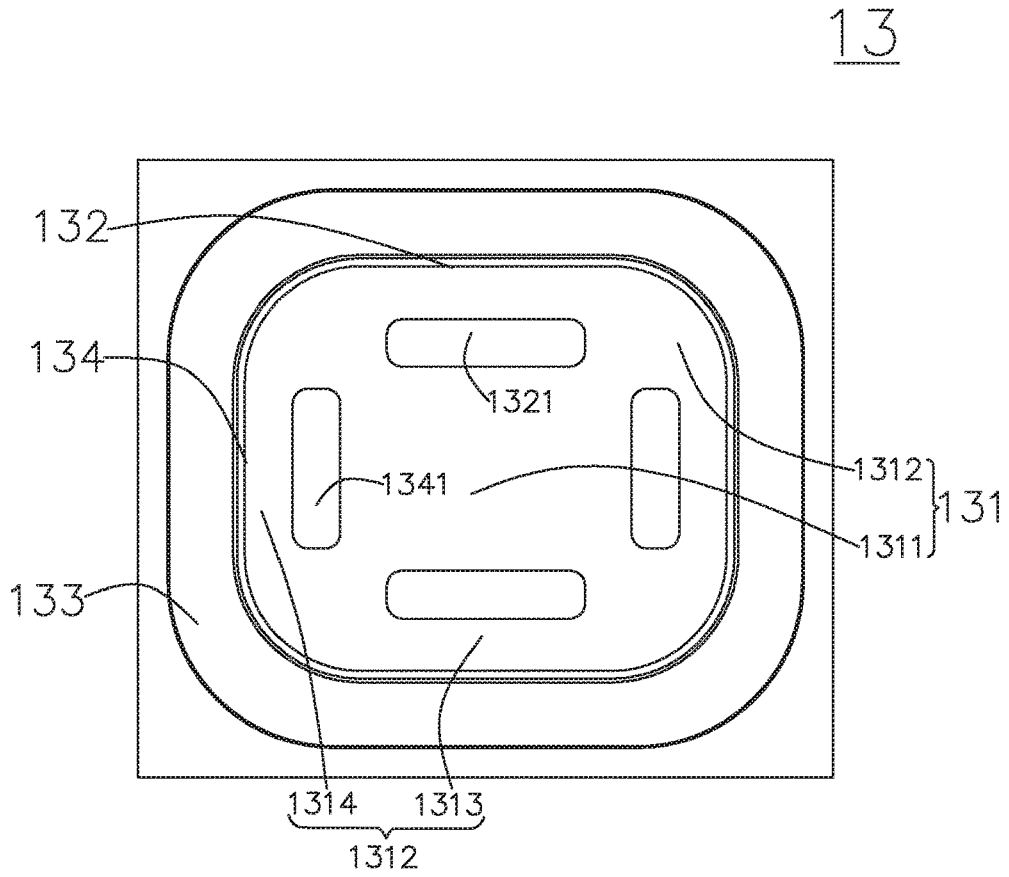
FIG. 2 is a plan view of a dome in the speaker according to the present disclosure.

As shown in FIG. 1 and FIG. 2, the present disclosure provides a speaker having a dome with a new structure. The speaker includes a basket 11, a diaphragm 13 fixed to the basket 11, a voice coil 15 located below the diaphragm 13 and used for driving the diaphragm 13 to vibrate and sound, and a magnetic circuit system 12 located below the diaphragm 13 and fixed to the basket 11. The diaphragm includes a dome 131 in a central region and a folded ring 133 surrounding the dome 131.

Figure 3:
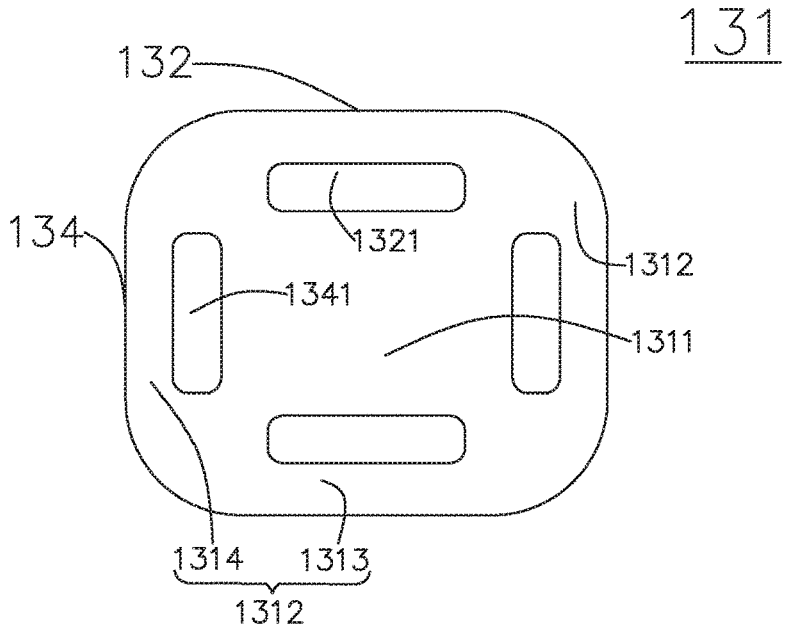
FIG. 3 is a plan view of the dome in the speaker according to the present disclosure.

In this embodiment, as shown in FIG. 1, the diaphragm 13 is rectangular, with one side close to a center of the diaphragm 13 as an inner side and one side away from the center of the diaphragm 13 as an outer side. As shown in FIG. 2 and FIG. 3, the dome 131 is a rectangle with rounded corners. The dome 131 includes two opposite first straight edges 132 arranged oppositely and two second straight edges 134 arranged oppositely and connected with the two first straight edges 132. In this embodiment, the dome 131 is a rectangle with rounded corners formed by connecting neighboring ones of the two first straight edges 132 and the two second straight edges 134 through a smooth transition surface, but the neighboring ones of the first straight edges 132 and the second straight edges 134 may alternatively be directly connected through a right angle (i.e., the dome 131 is rectangular). The dome 131 includes a central portion 1311 located in the middle and an edge portion 1312 surrounding the central portion 1311. The edge portion 1312 includes a first region 1313 arranged along the first straight edge 132 and a second region 1314 arranged along the second straight edge 134.

Further, both the first region 1313 and the second region 1314 are provided with an opening portion penetrating through the dome 131 along a vibration direction. Specifically, the first region 1313 is provided with a first opening portion 1321 close to the first straight edge 132, and the first opening portion 1321 is separated from the first straight edge 132. The second region 1314 is provided with a second opening portion 1341 close to the second straight edge 134, and the second opening portion 1341 is separated from the second straight edge 134. An orthogonal projection of the first opening portion 1321 along the vibration direction is the same as an orthogonal projection of the second opening portion 1341 along the vibration direction. Cross-sectional shapes of the first opening portion 1321 and the second opening portion 1341 vertical to the vibration direction are circular, rectangular or triangular. In other embodiments, the cross-sectional shapes may also be other irregular shapes. A cross-sectional area of the first opening portion 1321 is greater than a cross-sectional area of the second opening portion 1341 (see FIG. 2 and FIG. 3 for details). The above description is for illustration only and is not to be construed as limiting the present disclosure. In other embodiments, the cross-sectional area of the first opening portion 1321 may be the same with the cross-sectional area of the second opening portion 1341. By changing an opening position from the straight edge of the dome to the inner side of the straight edge, an influence on strength of the dome is avoided, and in addition, the mass of the dome 131 is effectively reduced through the opening portion at the inner side of the straight edge, and sensitivity of the product is improved.

Moreover, the dome 131 may alternatively have other shapes such as elliptical, polygonal, and the like. In the case that the folded ring 133 and the dome 131 are in a separate structure, the folded ring 133 is an annular hollow structure, such as a rectangular ring, a circular ring, an elliptical ring, and the like. The dome 131 is combined into a hollow portion of the folded ring 133. It should be noted that the folded ring 133 and the dome 131 may alternatively be in an integrated structure. The number of the first opening portion

1321 and the second opening portion 1341 may be determined according to an actual size of the product.

Comparing the speaker in the present disclosure with existing technologies, the opening portion is arranged at the inner side of the straight edge of the dome rather than at the straight edge of the dome, so that an influence on strength of the dome is avoided and high-frequency characteristic of the product is not affected. In addition, the mass of the dome is effectively reduced by setting the opening portion, and the sensitivity of the product is improved. Further, a blank area from an inner edge of the folded ring of the diaphragm to an outer edge of the dome is reduced, reliability of the diaphragm is increased, and the diaphragm wrinkling is not easy to be caused when the product is vibrating and falling.

It should be noted that those ordinary skills in the art may make various modifications and changes without departing from the inventive concept of the present disclosure, and these modifications and changes shall all fall within a scope of protection of the present disclosure.

What is claimed is:

1. A speaker, comprising a basket, a diaphragm fixed to the basket, and a voice coil located below the diaphragm and used for driving the diaphragm to vibrate and sound, wherein the diaphragm comprises a dome and a folded ring, the dome comprises two first straight edges arranged oppositely and two second straight edges connected with the two first straight edges; wherein the dome comprises a central portion located in the middle and an edge portion surrounding the central portion, the edge portion comprises a first region arranged along every first straight edge and a second region arranged along every second straight edge, and both the first region and the second region are provided with an opening portion penetrating through the dome along a vibration direction;

every first region is provided with a first opening portion close to the first straight edge; every second region is provided with a second opening portion close to the second straight edge; the two first opening portions and the two second opening portions are arranged in rectangle.

2. The speaker according to claim 1, wherein a cross-sectional area of the first opening portion is greater than a cross-sectional area of the second opening portion.

3. The speaker according to claim 2, wherein the first opening portion is separated from the first straight edge; the second opening portion is separated from the second straight edge.

4. The speaker according to claim 3, wherein an orthogonal projection of the first opening portion along the vibration direction is the same as an orthogonal projection of the second opening portion along the vibration direction.

5. The speaker according to claim 3, wherein cross-sectional shapes of the first opening portion and the second opening portion vertical to the vibration direction are circular, rectangular or triangular.

* * * * *